US005279409A

United States Patent [19]

Bowie et al.

[11] Patent Number: 5,279,409

[45] Date of Patent: Jan. 18, 1994

[54] CONTAINERS FOR FABRIC CONDITIONERS

[75] Inventors: Stuart S. Bowie, 5 Woodbrook La., Swarthmore, Pa. 19081; Eugene Potapov, Moscow, U.S.S.R.

[73] Assignee: Stuart S. Bowie, Swarthmore, Pa.

[21] Appl. No.: 935,996

[22] Filed: Aug. 27, 1992

[51] Int. Cl.[5] ..... F17C 13/00

[52] U.S. Cl. ..... 206/0.5; 206/219; 206/524.6; 252/90

[58] Field of Search ..... 206/0.5, 219, 221, 524.7, 206/524.6; 252/90, 92, 93; 8/158

[56] References Cited

U.S. PATENT DOCUMENTS 4,410,441 10/1983 Davies et al. ..... 206/0.5
4,720,351 1/1988 Flynn et al. ..... 252/90
4,835,804 6/1989 Arnau-Munoz et al. ..... 206/0.5
4,842,761 6/1989 Ruth ..... 206/524.6
5,129,120 7/1992 Cornette et al. ..... 206/0.5
5,132,036 7/1992 Falou et al. ..... 252/90

*Primary Examiner*—Joseph Man-Fu Moy

[57] ABSTRACT

A container for clothes conditioners having chambers for conditioners and for a pressure solution and an osmotic membrane covering the intake of the pressure chamber to permit osmotic flow of water from the rinse water of a washing machine to enter the pressure chamber which, in turn, causes a piston or similar means to transfer pressure into the conditioner chamber which causes the latter to break or to open to release conditioners into the rinse water.

19 Claims, 4 Drawing Sheets

CONTAINERS FOR FABRIC CONDITIONERS

STATEMENT AS TO FUNDING

No funds of the Government of the United States or of any State thereof or of any government of any country were used in the development of this invention.

SUMMARY

As described in Bowie U.S. Pat. No. 4,942,973, there are a large number of effective conditioners which have been developed by the art. However, particularly with respect to softeners, the technical problem is—and has been—to deliver the softeners into the rinse water of the washing machine after the detergent has been substantially flushed out of the water in order to avoid the reaction between components of the conditioners and of the detergent. (Herein, for convenience, "conditioner" includes fabric softeners and/or other conditioners used to treat clothes.)

The necessity of avoiding mixing detergent and fabric softeners is recognized in the technical literature. In addition, a warning not to do this is included in instruction manuals for washing machines. Thus, for example, the "Laundry Guide" for Whirlpool Automatic Washer Super Capacity Model LA5580XP (hereinafter sometimes called the "Whirlpool Machine") warns, at page 12, "Do not mix [fabric softeners] with any other laundry products. This includes detergent packaged water conditioners and bleaches. Mixing may cause greasy stains." Whirlpool Washing Machines are one of the most widely sold laundry machines in the United States.

The present invention solves the technical problem described herein. Thus, instead of pouches containing mixed conditioners and detergents, etc., or dryer sheets impregnated with conditioners, the present invention presents a radical departure from such unworkable delivery systems.

Accordingly, broadly described in a non-limiting fashion, this invention provides a new method for softening (conditioning) clothes and novel containers for conditioners.

In these embodiments, the containers of this invention open during the rinse cycle(s) (preferably during the final or "deep" rinse cycle) of a washing machine (or "washer") after the detergent is substantially discharged from the washer by the initial rinse water so that conditioners, such as fabric softener(s), can function to condition and soften the clothes in a superior manner heretofore not possible without the use of the aforementioned mechanical release devices. (Such automatic devices—which can malfunction—are available now only on very high priced washers. Thus, there are large numbers of older washers without such devices as well as newer low and moderate cost washers in use in the U.S. and other countries which do not have such automatic devices.)

Stated in a non-limiting way, the containers of this invention generally include at least one detachable or breakable part.

Preferred embodiments of the containers include a chamber for conditioners. The containers preferably are sold with conditioners in the conditioner chamber. The person washing clothes places the container into the washing machine at the beginning of the washing cycle, usually when the detergent is added to the machine. The present containers remain intact during the wash cycle, but the detachable component separates and releases the conditioner during the rinse cycle. In alternative embodiments, the container itself breaks or the conditioner is released through an outlet in the container during the rinse cycle.

In all such containers, the result is that the conditioner(s) or softeners thoroughly impregnate the clothes to provide very superior softening and other fabric conditioning effects during the final rinse.

To achieve the technical objectives described, the containers of this invention include an osmosis membrane (sometimes referred to herein as an "osmotic gate" or just "gate") which responds to the decreasing concentration of detergent vs. water in the washing machine during the rinse cycle(s) to permit the osmotic flow of water into a pressure chamber of the container. The "pressure chamber" may be the entire container (wherein the container itself is made of gate material) or one component chamber of the container.

In any event, when the gate "opens" (i.e., permits the osmotic flow of water into the pressure chamber), this increases the pressure within the pressure chamber. When the pressure increases to a sufficiently high level (the "threshold" pressure) in the pressure chamber, the pressure opens the "conditioner chamber" (the part of the container containing conditioners) so that conditioners are released to clothes during rinsing.

In this fashion, adverse precipitation reactions are prevented and conditioners can adequately permeate the clothing and thus provide optimum softening and other conditioning effects.

The gate (or membrane) of this invention uses "osmosis" phenomena which has been defined as "a passage of a pure liquid (usually water) into a solution (e.g., of sugar and water) through a membrane that is permeable to the pure water but not to the sugar in the solution. This passage can also occur when the two phases consist of solutions of different concentrations. The membrane is called semipermeable when the molecules of the solvent, but not those of the solute, can penetrate it. This pushing of water through a membrane into a solution results from a greater tendency of water molecules to escape from water than from solution" (The Condensed Chemical Dictionary revised by Gessner G. Hawley).

The gate is a semipermeable membrane, which may be of cellulose hydrate or many different types of plastic films. The gate functions as an osmosis (or "osmotic") membrane which permits water to pass into the pressure chamber causing an increase of pressure inside the pressure chamber in response to the decreasing of concentration of detergent in the washing machine outside of the pressure chamber.

In preferred embodiments, the pressure chamber as sold contains a "gauge" or "pressure" solution, i.e., the same or closely similar concentration of detergent and water as the "washer solution", i.e., the concentration of detergent and water which is used in the wash cycle.

In the examples hereof, the solvent is water unless otherwise specified, and the solute is detergent unless otherwise specified. The solute may be other than water and, in many cases, may be liquid(s) other than detergents.

DETAILED DESCRIPTION

Figure 1:
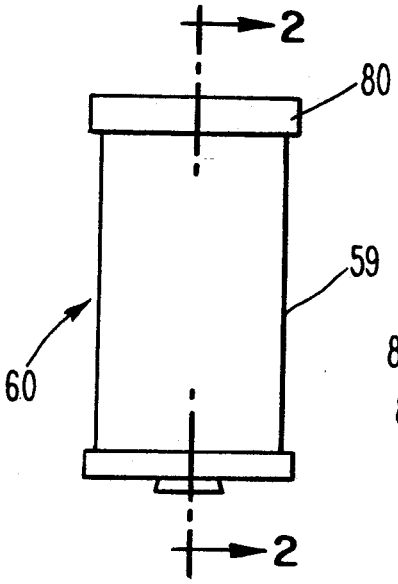
FIG. 1 is a perspective view, in elevation, of a first preferred embodiment of this invention.

As described above, the most serious flaw of present in-washer systems designed to condition clothes is that they mix detergents and conditioners—which react to coarsen the materials. (The term "in-washer systems" is used to distinguish prior art packets and the like which are placed in the wash water by hand from automatic mechanical devices which some high-priced washers have.) These in-wash systems, as well as the in-dryer systems (e.g., conditioner-impregnated dryer sheets) cannot provide uniform softening or other conditioning. As mentioned, both existing in-washer and in-dryer systems also frequently cause spots on the clothes. (Spots are the result of excessive concentrations of fabric softener on specific areas of clothes.)

Since few persons can sit by their washing machines (excluding machines having automatic dispensers for which this invention is not directed) until the detergent is rinsed out and then add conditioners to the final rinse, the art has completely failed to solve this important technical problem which exists for millions of washing machines in the U.S. alone.

The problem is solved by the present invention, as will be described in detail.

Generally, the present containers include a group having parts or components which break or fracture in response to pressure increase in the pressure chamber created by osmosis when the detergent/water concentration in the washer changes or wherein the conditioner chamber has a closure or plug which is forced out by such pressure to open the chamber to release the conditioner into the washer.

One group of preferred containers, as described below, usually comprises the following functional parts:

1. A semipermeable membrane ("gate") covering an opening in the pressure chamber separates the washing solution from the pressure solution in the pressure chamber. In use, this membrane is, on its outer surface, exposed to the washer solution, and its inner surface (i.e., the surface facing the interior of the pressure chamber), is exposed to the pressure solution in the pressure chamber. The membrane permits an osmosis flow of water into the pressure chamber when the concentration of detergent in the pressure solution inside of the pressure chamber exceeds the concentration of the detergent in the washer solution outside of the membrane. (Unless otherwise stated, "concentration", as used herein, means the detergent/water concentration.)

2. A pressure chamber filled with a pressure solution. (Unless otherwise stated, "pressure solution", as indicated, includes a detergent/water solution in a pressure chamber. However, it may include water and many other liquids and solutes in place of detergents.) The pressure solution (also called a "gauge" solution herein) is thus a solution of a selected concentration of water and detergent (or other liquid) which provides the necessary osmotic pressure inside the pressure chamber to cause the conditioner chamber to fracture, or to cause a part of the container to detach, or to otherwise cause the opening of the conditioner chamber when the concentration of detergent in the washer solution decreases to a level less than the concentration of detergent (or other solute) in the pressure solution in the pressure chamber. This occurs during the rinsing cycle, preferably during the "deep" rinse.

3. "Conditioner release means" which fractures, breaks or detaches from the container to release conditioners from the conditioner chamber when the pressure in the pressure chamber reaches a selected level.

Stated generally, most embodiments of this invention carry out the following method:

1. The machine rinsing water decreases concentration of detergent in the washing solution;

2. Osmotic pressure, created by the difference of concentration between the pressure solution and the washer solution, forces water from the washer solution to pass through the semipermeable membrane into the pressure chamber;

3. The water passing through the membrane into the pressure chamber causes increased hydrostatic pressure in the pressure chamber;

4. The increased hydrostatic pressure forces open the conditioner release means (or "lock system") to release fabric conditioner from the conditioner chamber.

A first preferred embodiment of this invention is shown in FIGS. 1–4. Thus, the main body of the container 60 is a rigid hollow cylinder or tube 59 which may be made of heavy gauge plastic or metal. Tube 59 has an interior surface 61 and an outer surface 61*a*.

Tube 59 has a piston 62 positioned in its interior. Piston 62 is capable of moving inside the bore of the container tube 59. Piston 62 has an outer liquid impermeable circumferential rim 63 which fits snugly against the inner wall 61 of tube 59 to prevent passage of liquids from chamber 67 to or from conditioner chamber 68.

The tube 59 has ends 70 and 71. End 71 is covered with an osmotic membrane 72 selected from the membrane group described herein (such as cellulose hydrate) which functions to permit the flow of water from the washer solution into pressure chamber 67 when the concentration of detergent in the washer solution is lowered due to the rinsing action described. The membrane 72 is held onto tube 59 by a cap 80 which is threaded onto tube 59 or otherwise adhered or affixed to the outer surface of tube 59 across end 71.

Figure 3:
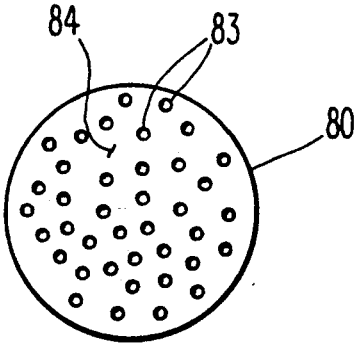
FIG. 3 is an end view showing the cap for the pressure chamber of the container of FIG. 1.

As shown in FIG. 3, cap 80 has many holes 83 in it to permit the solution in the washing machine to contact membrane 72. Cap 80, however, has sufficient flat surface areas 84 to prevent membrane 72 from ballooning or otherwise expanding in a direction away from the interior of the tube 59 during the flow of water during osmosis. Preferably, the membrane 72 is "sandwiched", i.e., held tightly, between outer cap 80 and an inner disc (not shown) which has holes in it like holes 83 to prevent membrane 72 from expanding or ballooning to the inside of tube 59.

The pressure chamber 67 is filled with pressure solution 85 and the conditioner chamber 68 is filled with conditioner solution (or powder) 90. The end 70 of the tube 59 adjacent the conditioner chamber 68 is covered by a rigid closure 87 of any suitable liquid impermeable material.

Closure 87 has a opening 88 which is closed by a tight-fitting, detachable plug 89. Plug 89 is made of any material, such as rubber or cork, which will stay in place during the agitation of washing and spinning, but which will be forced out by the pressure created by movement of piston 62. (Plug 89 and like devices shown herein are sometimes called "conditioner release means".)

The container of FIGS. 1–4 will remain intact during the wash cycle, but when the detergent concentration in the washer solution is lowered by rinsing, the increased osmotic pressure is very strong and quite sufficient to move piston 62 into conditioner chamber 68 to force plug 89 from opening 88, thereby releasing the conditioners from conditioner chamber 68 into the rinse water. As described, this preferably occurs during the "deep" rinse, which occurs after the initial rinses. (Piston 62 and like devices shown herein are sometimes called "pressure transfer means".)

Thus, the conditioners 90—especially fabric softeners—are released into the rinse water which has almost no detergent in it so that there will be virtually no adverse reactions between the detergent and the conditioner. Consequently, the conditioners are able to perform their function to soften and condition the clothes in a manner hitherto unknown in the art for washing machines not equipped with automatic conditioner dispensers.

Figure 5:
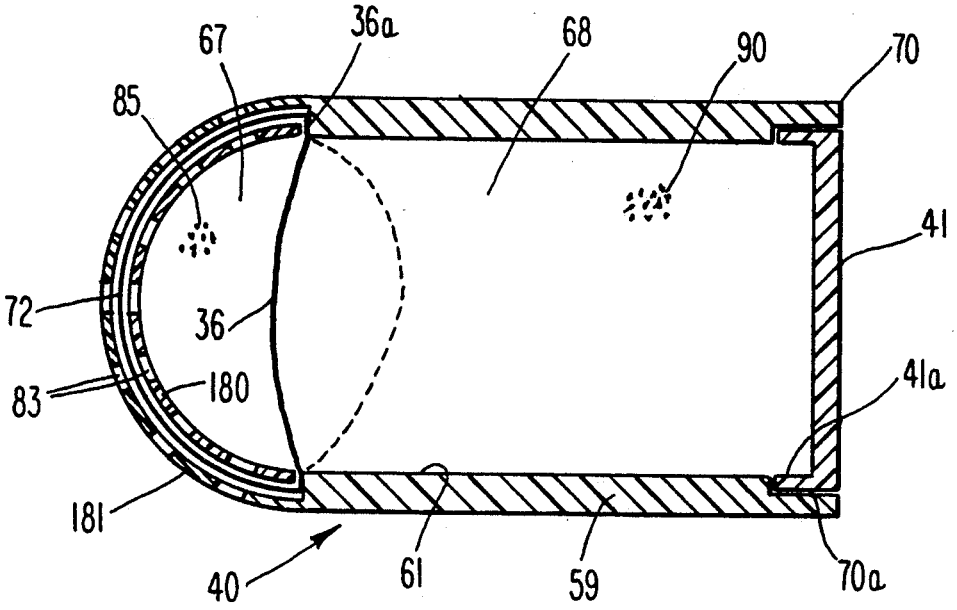
FIG. 5 is a view in cross-section similar to that of FIG. 2 of a second preferred embodiment of this invention.

FIG. 5 shows a container 40 which is a second preferred embodiment of the containers of this invention which has features in common with container 60 in FIGS. 1–4. (In all figures hereof, like numbers refer to like parts.)

In this embodiment, end 70 is closed by a detachable closure (or conditioner release means) 41 which has an inner annular flange 41 which is friction-fit into a recessed portion **70*a* of end 70. There is also a liquid-impermeable flexible film 36 which separates the chambers 67 and 68. Film 36 (pressure transfer means) is firmly adhered to the wall 61 by adhesive or other suitable means. Because it is flexible, film 36 easily moves or balloons toward end 70 as shown by the dotted line in FIG. 5 when the amount of pressure solution in chamber 67** increases due to osmosis.

Pressure chamber 67 in the second embodiment has a hemispherical semipermeable membrane 72 of suitable gate material. It is placed between two rigid hemispherical members 180 and 181. Members 180 and 181 have many openings 83 extending through their respective walls. Openings 83 thus provide holes which communicate from outside the container 60 into pressure chamber 67 and permit water from the washer to move into chamber 67 when membrane 72 allows this to occur by osmosis. Holes 83 may be square (mesh), circular or they may be roughly V-shaped wherein the area of each opening 83 on the outer surface of the members 180, 181 is less than the area of the opening at the inner walls of such members.

Membrane 72 is formed in a hemispherical shape and fits snugly between members 180, 181. Hemispherical members 180, 181 and adjacent membrane 72 comprise the inlet of the pressure chamber 67 in which there is pressure solution 85.

Similarly, conditioner solution 90 is contained in conditioner chamber 68 and will be discharged into the washing machine rinse water when the conditioner release means 41 is pushed to the right in FIG. 5 and detaches from its engagement within recess **70*a* of end 70. This occurs when the osmotic pressure in chamber 67 rises to push the pressure transfer means (film 36) into chamber 68 as shown by the dotted lines in FIG. 5. In turn, this movement transfers increased hydrostatic pressure into chamber 68 which detaches closure 41 from chamber 68** as described.

It is to be noted that film 36 is tightly adhered or otherwise affixed at its periphery to the interior wall of container 40 at **36*a* by adhesive or other suitable means. The area of film 36 is more than the area of the interior of container 40, so that film 36 can move in the bore of container 40 and therefore transfer pressure from chamber 67 to chamber 68**.

To illustrate the force and pressures involved in the containers of this invention, the following calculations have been made using the embodiments of the invention shown in FIGS. 1–4 and 5 as an model. (Similar forces will be created in the other embodiments shown and described herein and the calculations for the embodiment of FIG. 6 will be the same.) All calculations are approximate.

For the purpose of the following calculations, it is useful to consider a well-known washing machine to provide certain technical details relevant to the operation of this invention.

Thus, the widely used the Whirlpool Washing Machine previously identified has essentially the same basic properties and functions as most other widely used washing machines in the U.S. Thus, it has four water volumes for washing which are selected depending upon the amount of clothes to be washed: 29.5 liters, 45.8 liters, 61.7 liters and 77.6 liters. The recommended amount of powdered detergent for normal suds is 425 ml. for water hardness of 0–4 grains, 600 ml. for water hardness of 4–10 grains and 700 ml. for water hardness of 10–20 grains. Liquid detergents are used in amounts of 80 to 325 ml. depending upon the brand, water hardness and the amount the clothes are soiled.

For purposes of the present invention, an illustrative calculation can be made using 400 grams a detergent (i.e., essentially that which is recommended for water hardness of 0–4 grains.) Further, for the purpose of this calculation, the "warm" water temperature setting of the Whirlpool Washing Machine used for washing is 100 degrees F. (38 degrees C.) and the rinse water setting is "cold", which is in the range of 70–90 degrees F. or 20 to 30 degrees C.

In the heavy, regular and permanent press cycles of the Whirlpool Washing Machine, after the washing cycle is completed, the water/detergent solution is drained without agitation. Then there is a high speed spin of about 240 seconds, during which there are four water spray rinses. After that, the machine is filled with water for a so-called "deep" rinse which lasts for about 120 seconds. It is during this rinse, preferably, that the conditioners are to be released by the containers of this invention. After the deep rinse, the Whirlpool Washing Machine is drained of all liquid to the extent possible, after which there is a spinning cycle which includes spraying of water (except no water is sprayed during this final spin in the permanent press cycle.)

Thus, an illustrative calculation using FIG. 5 is as follows.

The tube 59 is given a diameter of 6 cm. Thus, the surface of the hemispherical membrane 72 in FIG. 5 is:

$$S=\tfrac{1}{2}\times 4/3\times PI\times r^2.$$

Where
PI=3.14 and
r=the radius of the tube=$\frac{1}{2}\times 6$ cm=3 cm.
Thus, S=18 cm (approximately).

The formula for calculating osmosis pressure is:

$$P=cRT,$$

where
c=the concentration of solute in [mol]/[liter];
R=0.08205 [atm]/([K][mol]) the gas constant (pressure in atmospheres, temperature in Kelvin);
T=temperature in Kelvin [K].

To calculate the concentration ("c"), 400 grams of detergent is used. The molecular weight of most detergents is in the range of 100–200 (see the Bowie '496 Patent). Therefore, selecting a molecular weight of 150 as well representative of commercially sold detergents, the result will yield a very good calculation of pressures and forces acting on and within the containers of this invention. For these calculations, the rinse water temperature is 25 degrees C., or 300 degrees K.

As mentioned, this calculation is merely an approximation of the real forces, pressures and volumes involved in the container. These forces, etc., will change to some degree as a function of variations in molecular weights of different detergents, membrane thickness, size of the container etc.

Thus, the mols in 400 grams of detergent is 400/150=2.6 mols.

A common volume of water in a standard size washing machine is 60 liters (V). Therefore, the concentration of detergent in the detergent/water washing solution at the onset of washing will be: c=mols/V=2.6/60=0.044.

The concentration of detergent (or other appropriate solute) in the washer at the outset of washing should be approximately the same as in the gauge solution. When the rinsing action has discharged most of the detergent from the washer, the difference in concentration inside the pressure chamber and outside the membrane will be (approximately): c=0.044.

Therefore, osmosis pressure in chamber 67 of FIG. 5 (which will be transferred to chamber 68) will be:

$$P=0.044\times 0.082\times 300=1.05\ \text{atm}=1.\ \text{kg/cm}^2=10^5\ \text{Pa}.$$

Thus, the force applied to closure member 41 of FIG. 5 from the pressure chambers 67 is:

$$F=PI\times r^2\times P=3.14\times 3^2\times 2.7=30.4\ \text{kg}.$$

Figure 2:
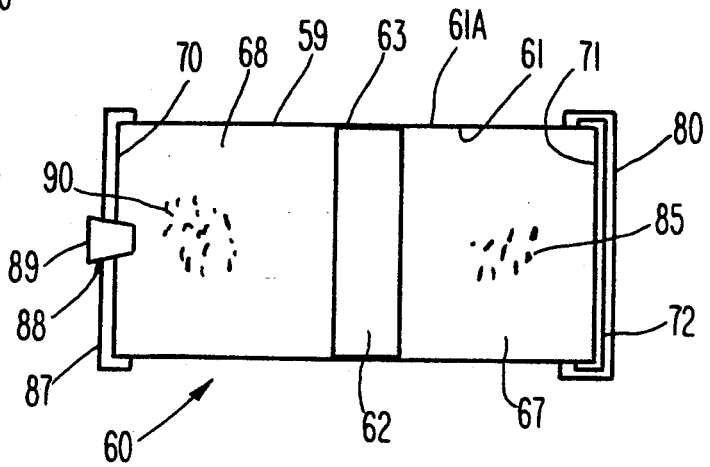
FIG. 2 is a cross-section of the container of FIG. 1 taken along the lines 2—2 of FIG. 1.
Figure 4:
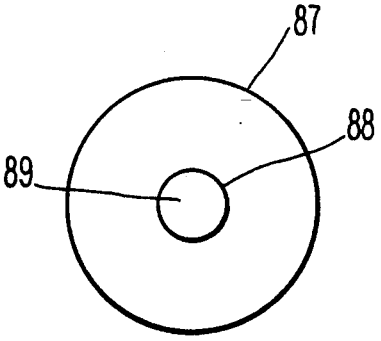
FIG. 4 is an end view showing the cap and plug for the conditioner chamber of the container of FIG. 1.

Using the same calculation system, it is possible to derive the force upon plug 89 in FIG. 2. Thus, the size of the opening closed by plug (closure member) 89 is 1 cm in diameter. Thus, the force which will be applied by osmosis pressure on plug 89 in FIG. 2 is:

$$PI\times r^2\times P=3.14\times 0.5^2\times 2.7=0.84\ \text{kg}.$$

The pressure of 30.4 kg. is more than sufficient to force closure member 41 out of opening 70 to thereby permit conditioner 90 to flow through openings 70 into the rinse water and condition the clothes, since the closure 41 is held in end 70 by a force far less that 30 kg. This is controlled by selection of a suitable material (e.g., an adhesive) and/or by adjustment of the force under which closure 41 is forced into end 70*a*. That force, moreover, is enough to force open many other closures, including those shown in the embodiments shown herein, since the closures are held in place by friction fit or adhesives (for example) whose adhesive force is far less than 30 kg.

Similarly, plug 89 of the container 60 in FIG. 2 may be detached from hole 88 by selection of an adhesive or friction fit having a holding force on plug 89 substantially less than 0.84 kg. Alternatively, plug 89 can be made much larger, in which case it will receive a much larger force.

The amount of water which will pass through membrane 72 is:

$$Q=(\text{area})\times(\text{time})\times(\text{osmosis pressure across the membrane})\times(\text{permeability})/(\text{film thickness})$$

The area of membrane 72 in FIG. 2 is 18 $cm^2$ and the osmosis pressure $P=10^5$ Pa. This permits the calculation of the approximate amount of water which infiltrates through membrane 72 into the pressure chamber 67 in a given time. Indeed, it is important to know amount of water that penetrates inside the pressure chamber 67 during rinsing to determine what work the osmosis force can perform to open the container.

Thus, in the Whirlpool Washer, it is desirable to dispense the conditioner only during the deep rinsing cycle, because prior to that, the concentration of detergent in the rinsing water will still be high. Thus, the desired time for optimum osmosis in this invention will be about two minutes of the deep rinse.

Thus, the least amount of the detergent in the rinse water will be during the last 100 seconds of the deep rinse. considering that the membrane 72 is 5 mils or about 0.1 cm or about 0.01 cm thick, then, in the 100 seconds Q cubic centimeters of water will penetrate through the membrane 72.

For a membrane 72 made of polyoxidimethylsilylene with permeability $3.2\times 10^{-9}[\text{cm}^3]\times[\text{cm}]/([\text{cm}^2]\times[\text{s}]\times[\text{Pa}])$:

$$Q=3.2\times 10^{-9}\times 18\times 100\times 10^5/0.01=60.\text{cm}^3.$$

For a membrane 72 made of cellulose hydrate with permeability $1.9\times 10^{-9}$: Q=36 $cm^3$.

Both values of Q above are more than enough to increase the pressure inside pressure chamber 67 to cause the pressure transfer means (e.g., piston 62) to transfer sufficient force to dislodge the conditioner release means (e.g., plug 89) to thereby "unlock" the conditioner chamber 68.

For example, 36 $cm^3$ of water will penetrate into conditioner chamber 68 of FIG. 5 and the force thereof will push closure 41 out of the container end 70 and thereby conditioner 90 will be discharged into the rinse water.

There are large group of materials which will function well as osmotic membranes in this invention. Of course, there are certain plastics which do not appear suitable for use as membrane 72. For an example of the latter, polyethylene of high density (HDPE 0.964 $g\times cm^{-3}$) with permeability $9.0\times 10^{-13}$ if used at the same conditions described, Q=0.017 $cm^3$. That is probably not enough to work in this invention.

Many other plastics, however, may be used for the membrane 72. Assuming the same conditions as described above, some of these plastics are:

1) Polyethyl methacrylate where Q=4.5 $cm^3$ of water.
2) Polyacrylonitrile-co-styrene 39/61 where Q=3.6 $cm^3$.
3) Polyoxy-2,6-dimethyl-1,4-phenylene where Q=5.8 $cm^3$.

With the foregoing calculations, it will be understood that there are many possible embodiments of the container of this invention. The embodiments now preferred are now described.

It is to be noted that membrane 72 can be made of many shapes and of a number of layers. However, certain shapes and layers are preferred. For example, preferred shapes of membrane 72 are as a part of a sphere, cone or cylinder.

Strengthening mesh(es), such as mesh 180, that resist (or absorb) pressure on the membrane 72 is (are) desirable to reinforce the osmotic membrane 72. The thinner and weaker the semipermeable film 72, the more reinforcing mesh is preferred to prevent distortion of membrane 72 under pressure.

Figure 6:
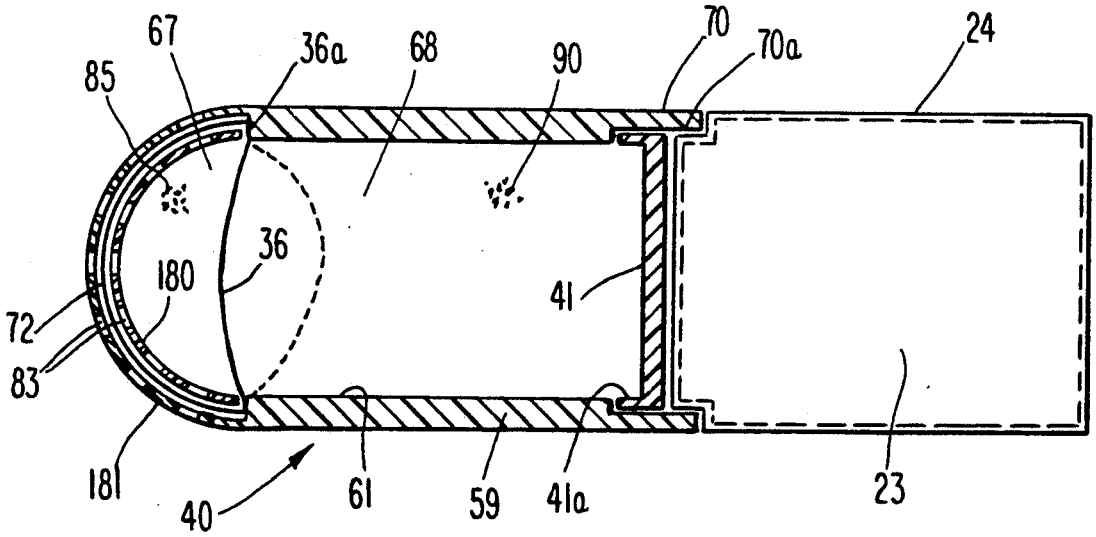
FIG. 6 is a view in cross-section similar to that of FIG. 5 of a third preferred embodiment of this invention having a detergent package attached.

As shown in FIG. 6, container 40 (or any other container embodiment herein) can be combined with a separable detergent package 23 which is released from container 40 at the outset of the washing cycle or dissolves in the wash water. One advantage of this combination is that it makes it possible to provide a container which provides proper amounts of conditioner and detergent which is a benefit in marketing the product.

Detergent 23 is preferably encapsulated in a water soluble film bag 24 and the initial wash water dissolves film 24 to release the detergent. The quantities of detergent in bag or pouch 24 and the conditioner in chamber 68 can be adjusted so that one container is proper for a small load in the washing machine, two containers for a medium load and three for a full load.

Figure 7:
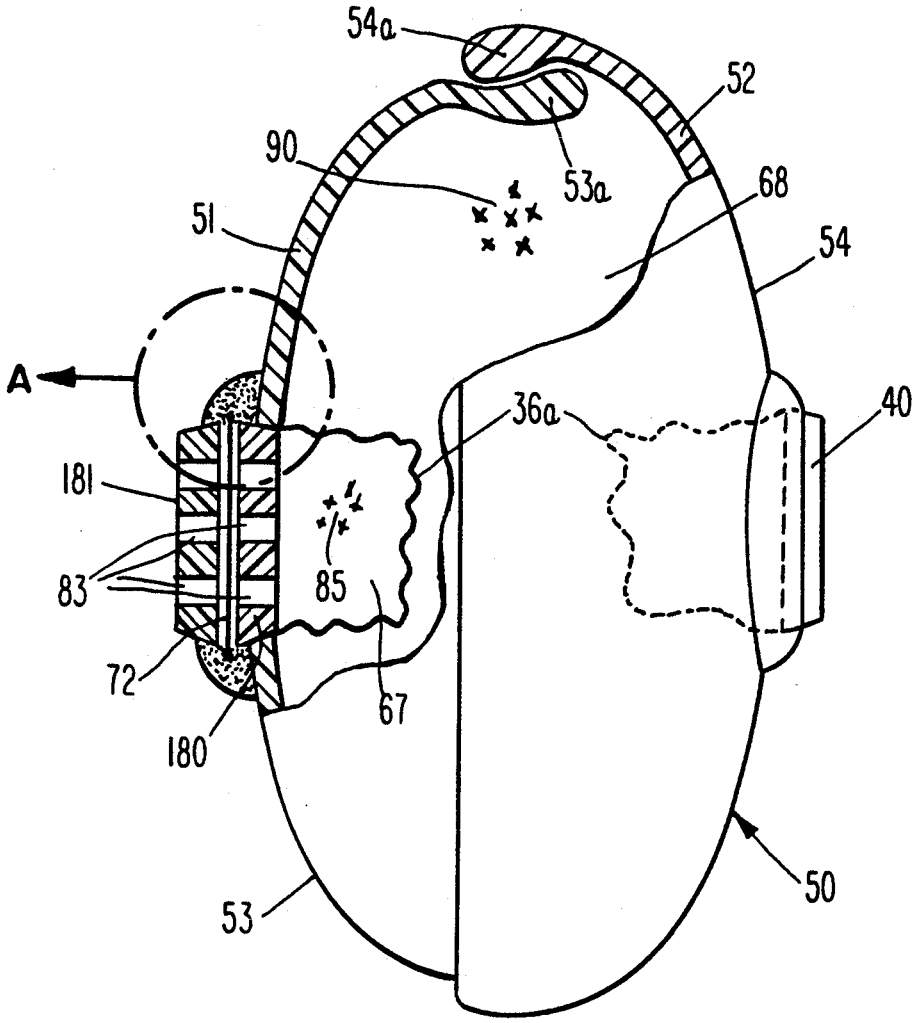
FIG. 7 is a perspective view, with certain parts removed to expose the interior, of a third preferred embodiment of this invention.
Figure 7A:
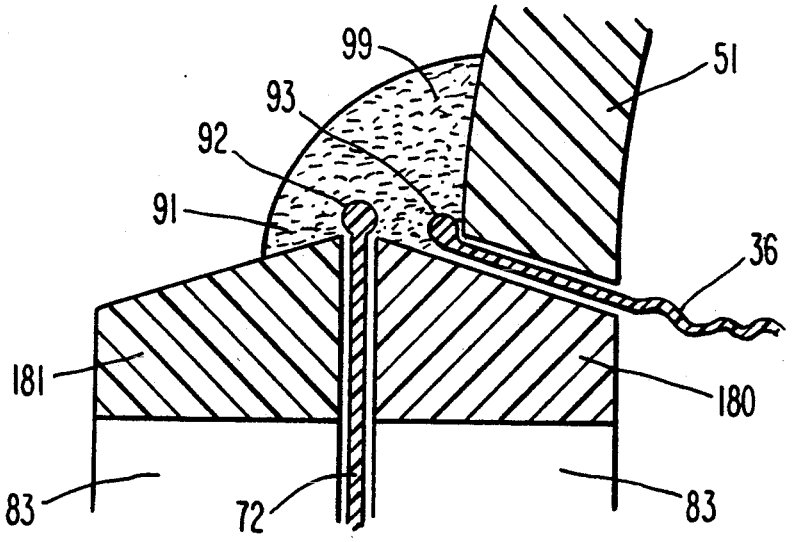
FIG. 7A is an enlarged view of section A of FIG. 7.

The embodiment FIGS. 7 and 7A comprises a container 50 which is formed by connecting two approximately hemispherical parts 51 and 52 made of plastic. Rims 53*a* and 54*a* which are the lower edges of the walls 53, 54 of parts of parts 51 and 52, are resilient and are enlarged. Rims 53*a*, 54*a* are shaped so that when parts 51 and 52 are pressed together, they interlock so strongly that they can be unlocked only by a strong internal pressure within container 50.

To provide hydrostatic pressure during the rinsing cycle, one or both of the components 51 and 52 of container 50 has at least one osmotic membrane block 40. Block 40 is placed in an opening of the wall(s) of parts 52 and/or 51.

As shown in FIGS. 7 and 7A, block 40 includes an osmotic membrane 72 placed between two rigid mesh walls 180 and 181 and is held at either end by an enlarged element 92. Walls 180 and 181 have aligned holes 83 to permit passage of water from the washer.

Each block 40 includes a bag 36*a* made of liquid impermeable flexible plastic. As shown in FIG. 9A, film 36 is held between wall 180 and an edge of wall 51. The ends of film 36 are enlarged as at 93 and are held by adhesive 99.

Film 36 thus forms a bag 36*a* and is filled with gauge solution 85. Each bag 36*a* is thus a pressure chamber 67.

The rest of the container 50, i.e., the area outside bag(s) 36*a*, comprises the conditioner chamber 68 and is filled with conditioner 90.

Water penetrating under osmosis pressure through the membrane 72 fills bag(s) 36*a* which act as a pressure transfer means and create hydrostatic pressure inside conditioner chamber 68. This pressure is stronger than the force locking holding rims 53*a* and 54*a* in engagement. Accordingly, rims 53*a*, 54*a* disengage and the two components 51 and 52 of the container 50 come apart which, in turn, permits conditioner 90 to flow into the rinse water.

Figure 8:
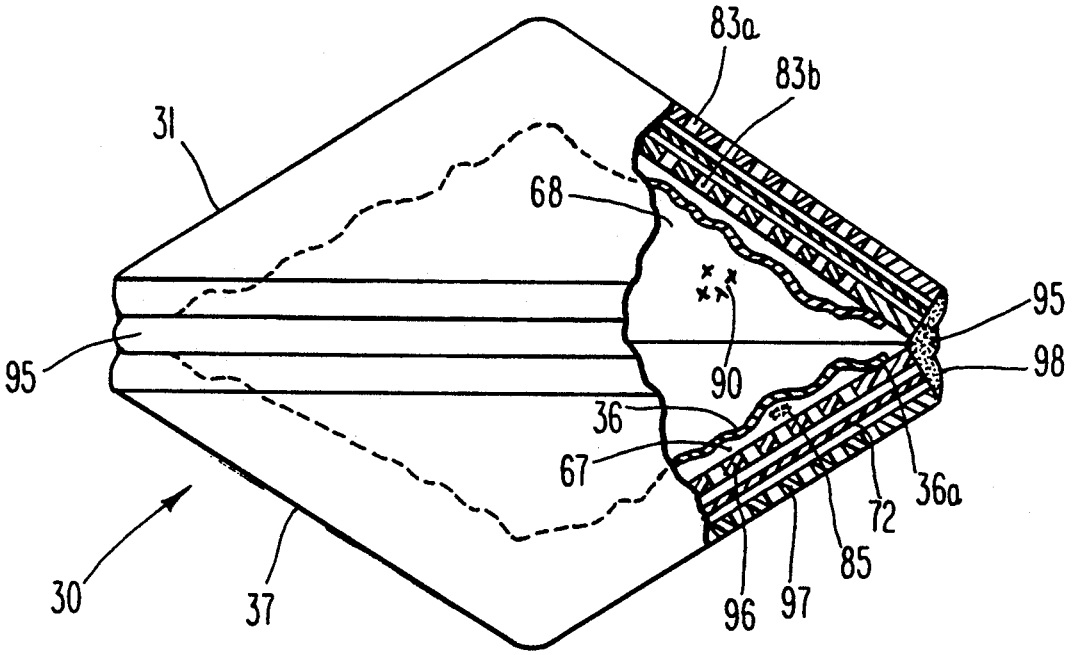
FIG. 8 is a perspective view, with certain parts removed to expose the interior, of a fourth preferred embodiment of this invention.

The embodiment of FIG. 8 comprises conical container 30 formed from the joinder of two identical initially hollow cones 31 and 37. Since each cone 31, 37 is identical, common parts are commonly numbered in FIG. 8.

Thus, the wall of each cone 31, 37 comprises an outer wall 97 and an inner wall 96. Each wall 96, 97 has, extending through the wall, openings 83*b* and 83*a*, respectively. These openings may be square (mesh) or of any other suitable configuration, including the openings described herein in connection with other embodiments.

Cones 31 and 37 are connected to each other along their lower edges by a frangible, water impermeable, brittle connecting material 95, such as a plastic (e.g., acrylic, formaldehyde) and, as will be seen, functions as a "lock" or conditioner release means within the meaning of this invention.

Between walls 96 and 07 there is a water permeable osmotic membrane 72.

A water impermeable film 36 is connected to the lower end of inner walls 96 by suitable material 95, such as water impermeable adhesive, at 36*a*. Since film 36 is only connected along the lower edges of walls 96, it is otherwise free to move within the interior of the container 30 and forms a conditioner chamber 37 which is filled with conditioner 90.

Because film 36 is connected to the edges of inner walls 96 hermetically, gauge solution 85 which fills the pressure chamber 67, can not penetrate the conditioner chamber 68 or vice versa.

Gauge solution 85 is placed in pressure chamber 67 between impermeable film 36 and the inner walls 96 of cones 31 and 37.

During the rinse cycle of the washer, rinse water flows through openings 83*a* and 83*b* of walls 97 and 96. By means of osmosis, the water flows through membrane 72 to thereby increase the hydrostatic pressure within pressure chamber 67 as well as in chamber 68 because the film 36 is very flexible and elastic and transfers the pressure without any significant loss. (Film 36 is one type of pressure transfer means used in this invention.)

The aforesaid internal pressure in chamber 67 cracks open connecting material 95 (which functions as a conditioner release means) so that cone members 31 and 37 separate and conditioner 90 is released into the rinse water.

We claim:

1. A container for clothes conditioners comprising:
(a) a conditioner chamber for the conditioners;
(b) a pressure chamber for a pressure solution;
(c) said container having pressure transfer means for transferring an increase in pressure in the pressure chamber in to the conditioner chamber;

(d) said pressure chamber having an intake opening extending to the outside of the container;

(e) an osmotic membrane positioned across said intake opening;

(f) said conditioner chamber having means for releasing conditioner to the outside of the container when there is an increase in pressure in the conditioner chamber caused by increased pressure in the pressure chamber.

2. The invention claim 1 wherein the pressure transfer means is a piston which moves in a bore inside the container.

3. The invention of claim 1 wherein the pressure transfer means is a film.

4. The invention of claim 1 wherein the pressure transfer means is an expandable bag.

5. The invention of claim 1 where the osmotic membrane is selected from the group consisting of cellulose hydrate and polyoxidimethylsilylene.

6. The invention of claim 1 where the osmotic membrane is selected from the group consisting of cellulose hydrate, polyoxidimethylsilylene, polyethyl methacrylate, polyacrylonitrile-co-styrene 39/61, polyoxy-2,6-dimethyl-1,4-phenylene.

7. The invention of claim 1 where the osmotic membrane is selected from the group consisting of polymeric plastics having a permeability to water large enough to permit passage of water through the membrane within about 100 seconds to create an increase in pressure in the pressure chamber and conditioner chamber sufficient to cause the conditioner release means to release the conditioner from the container.

8. The invention of claim 1 wherein an apertured rigid structure is positioned on one or both surfaces of the osmotic membrane.

9. The invention of claim 1 wherein the interior bore of the conditioner chamber is substantially circular in cross section.

10. The invention of claim 1 wherein the interior bore of the pressure chamber is substantially circular in cross section.

11. The invention of claim 1 wherein the conditioner chamber is formed at least in part by one or more walls of flexible film.

12. The invention of claim 1 wherein the pressure chamber is formed at least in part by one or more walls of flexible film.

13. A container comprising:

(a) A body member having a substantially cylindrical interior bore, said bore having first and second ends;

(b) pressure transfer means in the bore and movable therein;

(c) a pressure chamber positioned adjacent to the pressure transfer means;

(c) a conditioner chamber positioned adjacent to the pressure transfer means;

(e) first closure means for closing said first end of the bore and having openings for providing liquid passage from outside the body to the pressure chamber;

(f) an osmotic membrane positioned between said first closure means and said pressure chamber;

(g) second closure means for closing said second end of the bore; and (h) means for releasing conditioner from the conditioner chamber outside the body.

14. The invention of claim 13 wherein the pressure transfer means comprises a piston.

15. The invention of claim 13 wherein the pressure transfer means comprises a flexible film.

16. The invention of claim 13 wherein the first closure means has a substantially planar surface.

17. The invention of claim 13 wherein the first closure means has a substantially hemispherical shape.

18. The invention of claim 13 wherein the second closure means comprises a plug.

19. The invention of claim 13 wherein the second closure means comprises a detachable end closure.

* * * * *